US006230898B1

(12) United States Patent
Duffy

(10) Patent No.: US 6,230,898 B1
(45) Date of Patent: May 15, 2001

(54) MAILING MACHINES

(75) Inventor: Edward Philip Duffy, Hertfordshire (GB)

(73) Assignee: Printed Forms Equipment Ltd., Loughton (GB)

( * ) Notice: Subject to any disclaimer, the term of this patent is extended or adjusted under 35 U.S.C. 154(b) by 0 days.

(21) Appl. No.: 09/319,515

(22) PCT Filed: Dec. 4, 1997

(86) PCT No.: PCT/GB97/03354

§ 371 Date: Sep. 16, 1999

§ 102(e) Date: Sep. 16, 1999

(87) PCT Pub. No.: WO98/24563

PCT Pub. Date: Jun. 11, 1998

(30) Foreign Application Priority Data

Dec. 4, 1996 (GB) ..... 9625261

(51) Int. Cl.[7] ..... B07C 5/00; B07C 9/00
(52) U.S. Cl. ..... 209/509; 209/900
(58) Field of Search ..... 209/509, 900

(56) References Cited

FOREIGN PATENT DOCUMENTS 0 642 934 A1 3/1995 (EP) .
0 679 539 A2 11/1995 (EP) .

OTHER PUBLICATIONS

Descriptive sheet "P.F.E. I.S. Automailer 2, Intelligent System" Issue 2, Jul. 1995, Pitney Bowes Document F495052.

*Primary Examiner*—Donald P. Walsh
*Assistant Examiner*—Brett C. Martin
(74) *Attorney, Agent, or Firm*—Fitch, Even, Tabin & Flannery

(57) ABSTRACT

A mailing machine including a scanner for detecting data marks printed on documents to be mailed for conveying control information to the machine, for example in the manner known as the "Optical Mark Recognition" system. The machine includes a memory buffer for storing data concerning the marks if the user inputs data indicating that the reference or "gate" mark is at the end of the group of marks. The data may then be read from the buffer in the reverse order. Thus, the data marks may be printed in the same position on all documents regardless of the fold configuration, and thus feed orientation, which is required.

4 Claims, 3 Drawing Sheets

1. GATE MARK
2. END OF GROUP (STOP)
3. PARITY
4. SELECT FEED 1
5. SELECT FEED 2
6. SELECT FEED 3
7. FORM SEQUENCE NUMBER 1
8. FORM SEQUENCE NUMBER 2
9. FORM SEQUENCE NUMBER 3
10. FORM SEQUENCE NUMBER 4
11. FORM SEQUENCE NUMBER 5
12. DIVERT MARK 1
13. DIVERT MARK 2
14. DIVERT MARK 3

MAILING MACHINES

This invention relates to mailing machines.

Mailing machines are known which draw documents in the form of sheet material from one or more feeding stations, collate the required number of sheets, fold them in a selected way, add inserts to the folded collation, and insert it into an envelope. For example the documents may be bank statements, which may comprise one, two, or more sheets, and the inserts may be information about banking services.

In order that the documents may be collated correctly for each envelope, and that the appropriate inserts may be added, etc., the sheets typically include data marks to be read by the machine which indicate the required information about the mailing. This is known as the OMR or "Optical Mark Recognition" system. For example, the presence or absence of a mark in a particular location may indicate the sequence member of the sheet in a group (to check that there has been no mis-feed), whether it is the last sheet in a collation to be mailed, whether a particular insert should be included in that mailing, etc.

To read the marks, the sheets are fed past a scanner connected to a data processor for controlling the various functions of the machine. The data processor is first programmed for a particular job by inputting the positions in which marks may appear, and the corresponding control action associated with that mark position. Conveniently, the marks are printed as horizontal lines along the left hand margin of the sheet, although they may be printed in any other required position. Since the position of the printed matter on a sheet can vary slightly due to the limitations of the printer used, the first mark is always present on every sheet and acts as a reference mark for the positions of the other marks. Therefore as soon as the scanner "sees" the reference or 'gate' mark, the exact relative position of the set of marks is known and the marks can be interpreted in real time.

After the sheets have been scanned, they are then treated according to the information obtained by the scanner and processor. Thus they may be collated with the previous sheet, the collation may be folded, and various inserts may be added as indicated by the marks, before insertion into envelopes. Also in accordance with the marks, certain envelopes may be diverted, for example in order to sort the envelopes by address.

Typically the sheets are A4 sized, and are folded either twice into three sections, for insertion into a C5 type envelope, or once into two sections, for insertion into an A5 sized envelope. When folded twice, this may be either a "C" fold (each end being folded towards the same side of the sheet) or a "Z" fold (each end being folded towards the opposite side), according to the requirements or preferences of the mailer. Mailing machines are known which are capable of selectively performing a number of different folding configurations. However, these may require the sheets to be drawn into the machine in a different orientation, i.e. 'feet first face down' for a 'C' fold, and 'head first face up' for a 'Z' fold. This means that for sheets printed in the same way the gate mark would sometimes be at the end of the set of marks, such that the marks could not be interpreted. Thus it is usual to require that the marks are printed in different places on the sheets depending upon a required fold, or to use a different machine for different fold configurations.

It is an object of this invention to provide a machine which can provide a number of different fold configurations, but which does not require the marks to be printed differently for each one. Thus the user could always print the marks in the same place, simplifying the software requirement for printing the marks, and simply programme the machine according to the fold configuration required.

According to the present invention, there is provided a mailing machine comprising an optical scanning means, transport means for feeding documents to be mailed successively past the scanning means, a data processor operatively connected to the scanning means to receive data therefrom, and operatively connected to a data input means for receiving data relating to a particular set of documents therefrom, the data processor being arranged to compare the data from the scanning means with the data from the data input means, and having output means for outputting control data to means for controlling the mailing machine, the data processor comprising a memory buffer and being arranged selectively in accordance with the input data to store data from the scanner in the memory buffer and to read the data from the buffer in the reverse order. Thus it is unnecessary to print the marks differently when different fold configurations are required, but the user may merely programme the device with data showing that the "gate" mark is either the first or the last mark, and the device will operate accordingly.

The invention will now be described with reference to the accompanying drawings, in which.

Figures 1, 2:
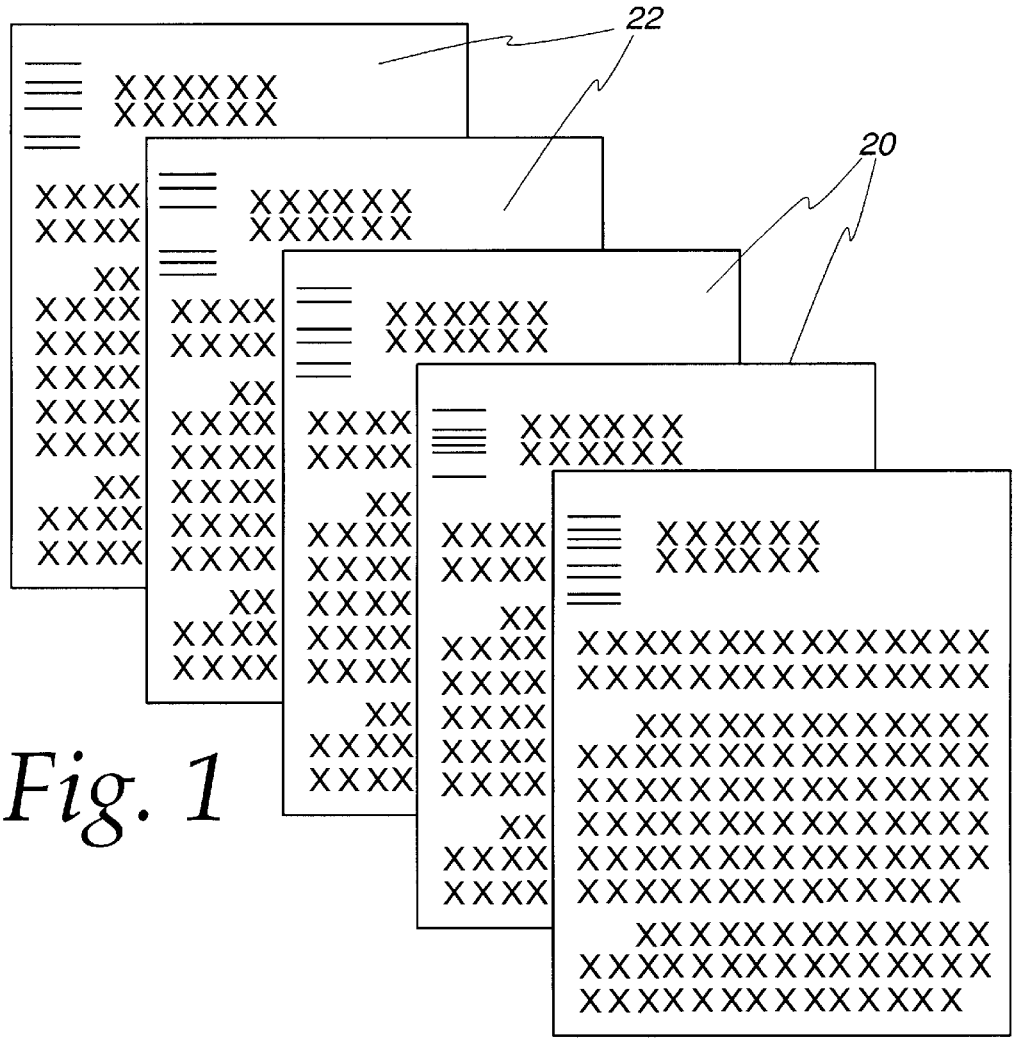
FIG. 1 shows a set of sheets bearing different sets of marks.
FIG. 2 is a table listing the meanings of the marks.

Referring to FIG. 1, sheets 20 to be mailed are each printed with a set of data marks 22. There are in this example 11 possible mark positions. The table in FIG. 2 describes the meaning of a mark in each position. All sets of marks include a gate mark in position "1". Each set may optionally also include a mark in any of the other positions "2" to "14", depending upon the information concerning the treatment or position of that sheet. For example, a mark in position "2" indicates that the sheet is the last in the group to be collated for one mailing. Marks in positions "4", "5" or "6" indicate that an insert from one of the feed stations should be added to the collation. Marks in positions "7" to "11" give a binary number indicating the sequence number of the sheet. Thus, if the machine does not receive successive sheets bearing successive numbers, a fault condition may be actuated (e.g. the machine may stop). This is to prevent mis-mailing of documents (that is, mismatching of a document with an envelope) which may be particularly important where confidential material such as bank statements are being mailed. The sheet may have a mark in position "12", "13", or "14" which would indicate that the collation should be directed to any of three diverted positions. For example there may be separate bins for containing mail going to different areas (e.g. UK, Europe, worldwide).

Figure 3:
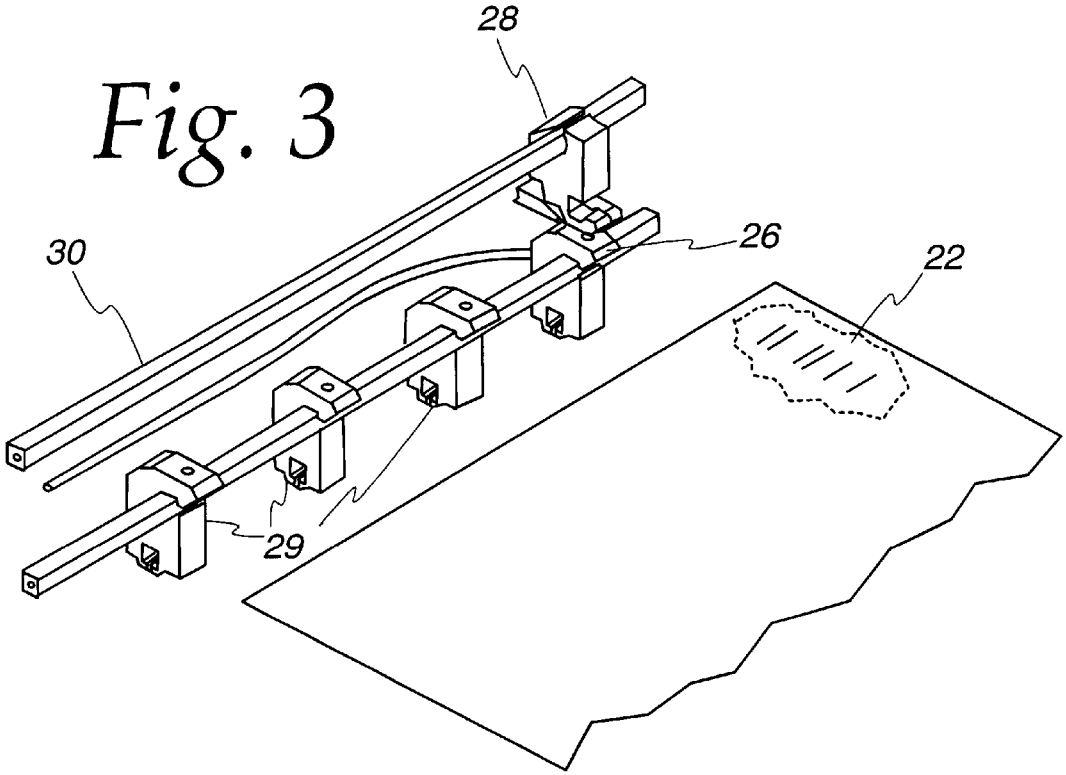
FIG. 3 shows a perspective view of an optical mark scanning head suitable for use with the present invention.
Figure 4:
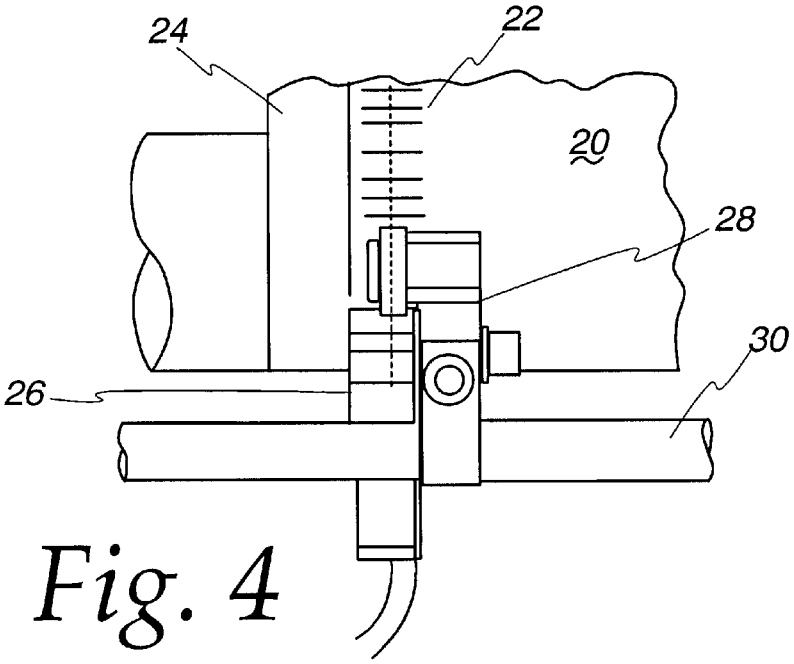
FIG. 4 is a plan view of part of the reader head of FIG. 1.

Referring now to FIGS. 3 and 4, the sheets are conveyed by means of a conveyor belt 24 successively past a scanning station comprising a scanning head 26 and a guide member 28. Alternative scanning heads 29 are mounted below the feed path and may be positioned conveniently at intervals across the width of the sheets 20, for use depending upon the position of the marks to be read. The guide member 28 is mounted on a rail 30 above the feed path, and can be slid along the rail 30 to be located opposite the active scanning head, so as to guide the sheet flat over the head. In this example, the set of marks 22 is on the right hand side of the sheet which is face down, and the guide member 28 is positioned opposite the corresponding scanning head 26.

The scanning head 26 is connected to a data processor 32. The user first inputs data relating to the marks being used for that particular job by means of a keyboard 34. Thus the position of each possible mark on the sheet of paper is entered, together with the size of the "window" or variation in position that may occur. For example the "gate" mark may be at 50 mm from the top edge of the paper with a possible variation of 6 mm. The "end of group" mark may be at 6 mm after the "gate" mark, with a variation of 3 mm, etc. The user also enters the direction of paper feed. For example the user may require that the paper is fed in the opposite direction, i.e. with the bottom edge leading.

Figure 5:
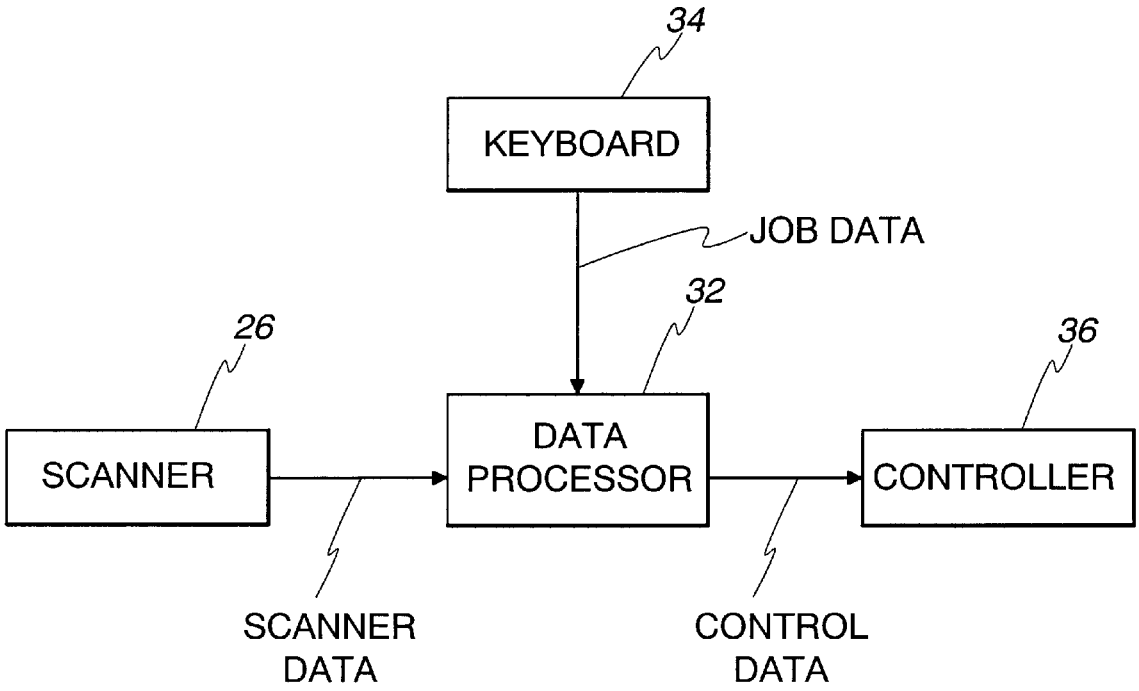
FIG. 5 is a diagram of machine control process.

Referring also to FIG. 5, in use, the scanner 26 scans a sheet and inputs a stream of data concerning the positions of any marks to the data processor 32. If the sheet is being fed such that the gate mark is the first mark, the data processor compares the position "window" for the gate mark which has been input by the user with the position of the first mark observed by the scanner. If the first mark falls within the "window", the processor recognizes it as the gate mark and calculates the positions of the other mark windows and compares them with the positions of the other observed marks with respect to the gate mark in real time, and outputs corresponding control data to the machine controller 36, which controls the various functions of the machine, in the known manner.

However, if the input data indicates that the sheets are to be fed with the gate mark last, the processor stores the scanner data in a memory buffer. When the last mark has been read, the processor 32 calculates whether it is within the gate mark window, as before, calculates the positions of the other possible marks, and then calculates the relative positions of the other marks with respect to the gate mark by reading them from the memory on a "last in first out" basis. The control data is then sent to the machine controller 36 as before.

What is claimed is:

1. A mailing machine comprising an optical scanning means, transport means for feeding documents to be mailed successively past the scanning means, a data processor operatively connected to the scanning means to receive data therefrom, and operatively connected to a data input means for receiving data relating to a particular set of documents therefrom, the data processor being arranged to compare the data from the scanning means with the data from the data input means, and having output means for outputting control data to means for controlling the mailing machine, the data processor comprising a memory buffer, and being arranged selectively in accordance with the input data to store data from the scanner in the memory buffer and to read the data from the buffer in the reverse order.

2. A mailing machine as claimed in claim 1, in which the scanning means is arranged to scan each document along the direction of feed of the document, and to detect the presence of one or more data marks spaced on the document along the said direction.

3. A mailing machine as claimed in claim 2, in which data is stored in the memory buffer in response to input data which indicates that documents are to be fed such that a reference mark is the last of the data marks to pass the scanning means.

4. A mailing machine as claimed in claim 1 in which the means for controlling the mailing machine comprises at least one of collating means, folding means, inserting means, and diverting means.

* * * * *